US006226801B1

(12) United States Patent
Alexander et al.

(10) Patent No.: US 6,226,801 B1
(45) Date of Patent: May 8, 2001

(54) FOOTBALL HELMET HAVING A REMOVABLE INFLATABLE LINER AND A METHOD FOR MAKING THE SAME

(75) Inventors: Cherie Alexander; Peter David Halstead, both of Knox; Brian Howard, Cookeville, all of TN (US)

(73) Assignee: Adams USA, Inc., Cookeville, TN (US)

( * ) Notice: Subject to any disclaimer, the term of this patent is extended or adjusted under 35 U.S.C. 154(b) by 0 days.

(21) Appl. No.: 09/450,492

(22) Filed: Nov. 29, 1999

Related U.S. Application Data

(63) Continuation-in-part of application No. 09/296,007, filed on Apr. 21, 1999, now Pat. No. 6,073,271.
(60) Provisional application No. 60/119,270, filed on Feb. 9, 1999.

(51) Int. Cl.[7] ..... A42B 3/10
(52) U.S. Cl. ..... 2/413; 2/414
(58) Field of Search ..... 2/410, 411, 413, 2/414, 425

(56) References Cited

U.S. PATENT DOCUMENTS

| | | | |
|---|---|---|---|
| 3,600,714 | 8/1971 | Cade . | |
| 3,761,959 | 10/1973 | Dunning . | |
| 3,849,801 | 11/1974 | Holt . | |
| 3,906,546 | 9/1975 | Gooding . | |
| 3,994,021 | 11/1976 | Villari . | |
| 4,060,855 | 12/1977 | Rappleyea . | |
| 4,566,137 | 1/1986 | Gooding . | |
| 5,014,365 * | 5/1991 | Schulz | 2/412 |
| 5,263,203 * | 11/1993 | Kraemer et al. | 2/413 |
| 5,846,063 | 12/1998 | Lakic . | |

FOREIGN PATENT DOCUMENTS

| | | |
|---|---|---|
| 919352 | 1/1973 | (CA) . |

OTHER PUBLICATIONS

Schutt Sports Product Catalog 1996, pp. 1–9.
Riddell Youth Catalog Online, http://riddelll.com/ (last modified Nov. 15, 1998).

* cited by examiner

*Primary Examiner*—Michael A. Neas
(74) *Attorney, Agent, or Firm*—Stites & Harbison, PLLC; David W. Nagle, Jr.; Vance A. Smith

(57) ABSTRACT

The invention pertains to protective helmet that has an inflatable liner that is constructed with a multiplicity of cells each separated by constrictions of a narrower cross-section. The liner has a central ring and a plurality of loops extending therefrom adapted to protect various portions of the wearer's skull. The structure of the liner permits the liner to be molded using various molding techniques.

10 Claims, 4 Drawing Sheets

FOOTBALL HELMET HAVING A REMOVABLE INFLATABLE LINER AND A METHOD FOR MAKING THE SAME

This application is a continuation-in-part of commonly assigned, co-pending application Ser. No. 09/296,007, filed Apr. 21, 1999 now U.S. Pat. No. 6,073,271, U.S. Provisional Application No. 60/119,270, filed Feb. 09, 1999. The present invention pertains to protective headgear of the type used in athletic events by the participants, and, particularly to protective headgear used in American football.

BACKGROUND OF THE INVENTION

To minimize head injuries such as skull fractures and head and scalp lacerations in athletic events, it is well known, indeed mandatory in most instances, to wear specially designed headgear. Typical protective headgear used in football contests is comprised of rigid shell internally lined with a plurality of energy-absorbing pads. One type of lining which has shown promise uses a bladder, typically disposed between the helmet and padding that contacts the wearer's head. An example of a helmet protecting system using such a bladder is found in U.S. Pat. No. 3,600,714 issued to Cade on Aug. 24, 1971 in which the bladder is formed with a centrally disposed sump and valve connected to front, rear, and side extensions. The bladder has a multiplicity of connecting cells and is filled with a hydraulic liquids such as various types of oils or glycerine. Upon impact, the incompressible fluid in the cells is distributed to the other cells and sump. Thus, the effect of the force at the point of impact is dissipated through out the bladder system. Still another advantage to this type of bladder is that it can be adjusted to a limited extent to accommodate various head sizes by changing the size of the cells through an increase or decrease in the amount of fluid placed in the cells.

More recently, gaseous inflatable liners have been used within helmets to assist in dissipating impact forces. However, the structure of the prior art gaseous inflatable liners dictate that the liners be molded into complex shapes. Such shapes are formed into a substantially rigid liner that complement the top part of the wearer's head prior to inflation and before being placed within the shell of the helmet. Because of the complex shape of the liner, it is necessary to use sophisticated and more costly molding techniques such as "rotational" molding. This process is a three stage, no pressure plastic molding process. In the first stage, a mold containing a plastic charge is heated and then rotated bi-axially. Heat transfer causes the charge to melt within the mold. During the second stage, the mold continues to rotate but is cooled. During this stage the plastic charge coats the internal surfaces of the mold and hardens. The formed hollow piece is then removed from the mold during the third stage and the mold then is recharged.

Prior art liners also suffered from problems of non-uniform inflation wherein some portions of the liner may be over-inflated whereas others are under-inflated. Non-uniform inflation can adversely affect the fit of the helmet and the protection it provides. In prior art helmets, it is especially common for the portion of the liner adjacent the inflating valve to over-inflation and bulge out.

It is therefore an object of the present invention to provide for an inflatable liner having a final shape and structure that is easily manufactured by a plurality of different molding techniques and adapted to be easily flexed and positioned into a shell of a helmet.

It is still another object of the present invention to provide an inflatable liner that when inserted into a helmet frame minimizes non-uniform inflation.

It is yet another object of the present invention to provide for an inflatable liner that is essentially flat on the side adapted to abut the helmet and essentially rounded on the other side adapted to abut the wearer's head.

Still another important object of the present invention is to provide an inflatable liner that can be removably inserted into and positioned among a configuration of pads so as to form a co-extensive surface with the surfaces of the pads for abutment against the head of the wearer.

These and other objects and advantages of the present invention will become apparent upon a reading of the following description along with the appended drawings.

SUMMARY OF THE INVENTION

The present invention pertains to an inflatable liner for use in a protective helmet that includes an inflatable seamless body defining a multiplicity of internally disposed cells separated from the adjacent cells by constrictions having a smaller internal cross-sectional area than the cells. The cells and the constrictions form a continuous passageway throughout the liner. The seamless body has a structure and is flexible enough to be supported in an essentially flat arrangement by an underlying support surface following molding yet can be inserted into and take on a complimentary shape of a helmet. The liner is additionally removably inserted within an area between the protective pads fastened to the shell of the helmet and held in place by frictional engagement with the periphery of the pads. The liner is constructed to have five major groupings of cells: a centrally disposed ring and four groups, preferably loops, of cells and constrictions that extend outwardly from and are in gaseous communication with the ring. The ring is adapted to be positioned against and protect the top part of the wearer's skull. A rear loop of the cells and constrictions is adapted to be positioned against and protect the lower portion of the wearer's skull. A pair of side loops of the cell and constrictions are adapted to be positioned against and protect the sides of the wearer's skull. Finally, a front loop of the cells and constrictions is adapted to be positioned against and protect the top front portion of the wearer's skull. The entire surface of one side of the liner is substantially flat to facilitate the abutment thereof against the internal surface structure of the helmet. The liner has a valve cell that extends into the open area defined by the central ring and has a valve stem for changing the air pressure within the liner. Because the loops contact only the central ring and are otherwise structurally independent of one another, the entire liner can be molded into a relative flat shape, thus permitting less expensive and simpler molding processes to be used.

DETAILED DESCRIPTION OF THE PREFERRED EMBODIMENT

Figure 1:
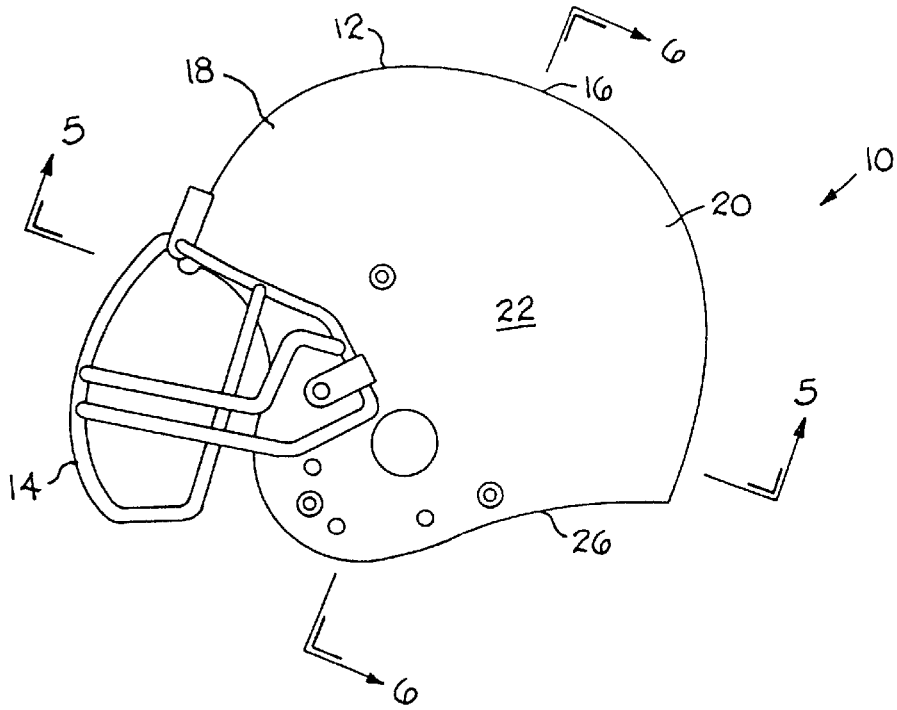
FIG. 1 is a side view of a football helmet with an inflatable liner made in accordance with the present invention.
Figure 2:
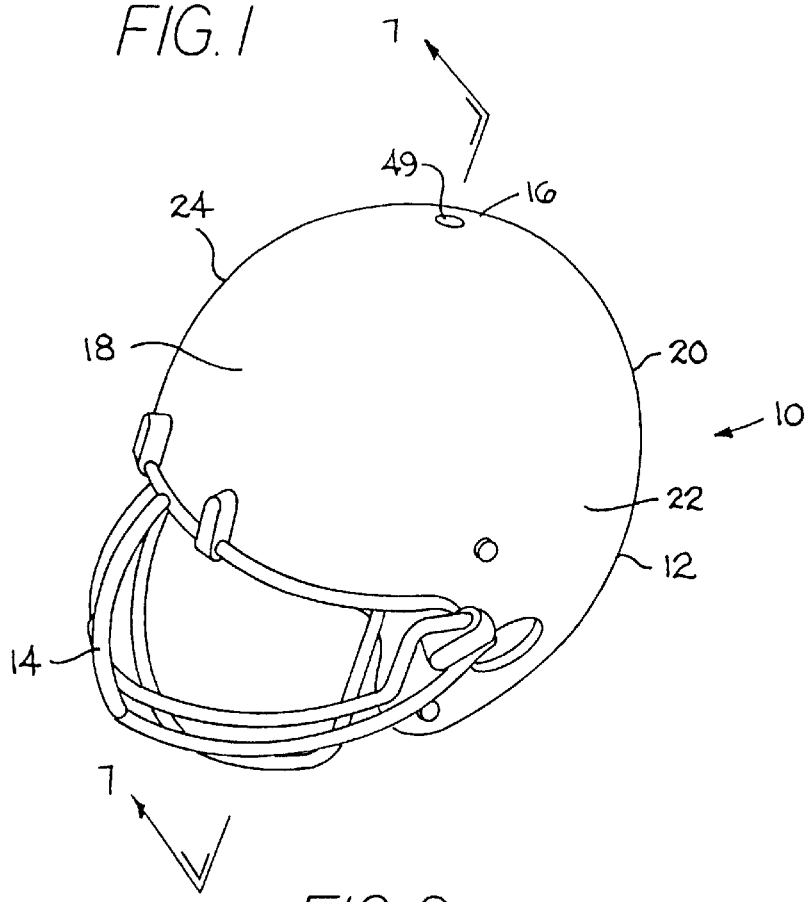
FIG. 2 is a perspective of the football helmet shown in FIG. 1.

FIGS. 1 and 2 depict the outer structure and shape of a typical football helmet 10 in which the liner of the present invention may be positioned. Helmet 10 has a hollow, rigid shell 12 that covers the upper and lateral parts of the wearer's skull and a face mask 14 that offers some protection to the wearer's face. Structurally, the shell 12 is comprised of a crown portion 16, a front portion 18, a rear portion 20, a left portion 22, and a right portion 24 that collectively define a head opening 26. The shell 12 is shaped to compliment and surround the wearer's skull and external head portions. The shell 12 may be made of various materials such as, for example, acrylonitrile butadiene styrene.

Figure 4:
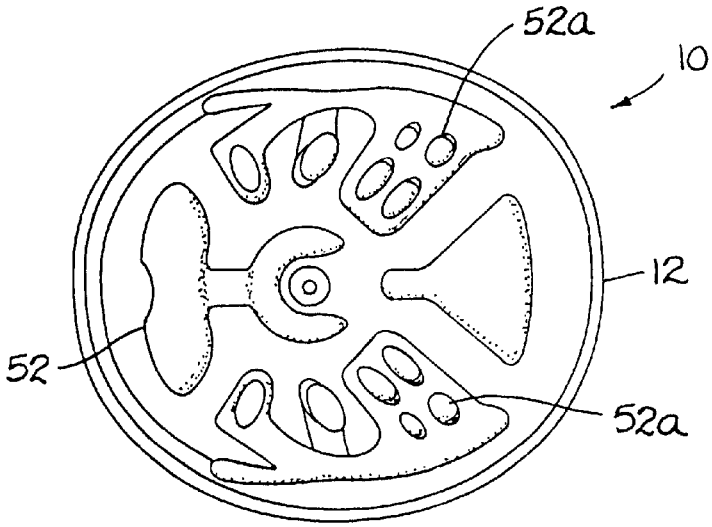
FIG. 4 is a bottom view of the shell portion of the football helmet of FIG. 1 with the inflatable liner removed to show the preferred positioning of the internal padding of the helmet.

As seen in FIG. 4, pads 52 line the interior of shell 12 and form a configuration that has a periphery which is adapted to abut and position an inflatable liner in accordance with the present invention. As will be discussed more fully below, the pads 52 and the liner collectively form a co-extensive surface that abut the skull of a wearer of the helmet 10.

Figure 3:
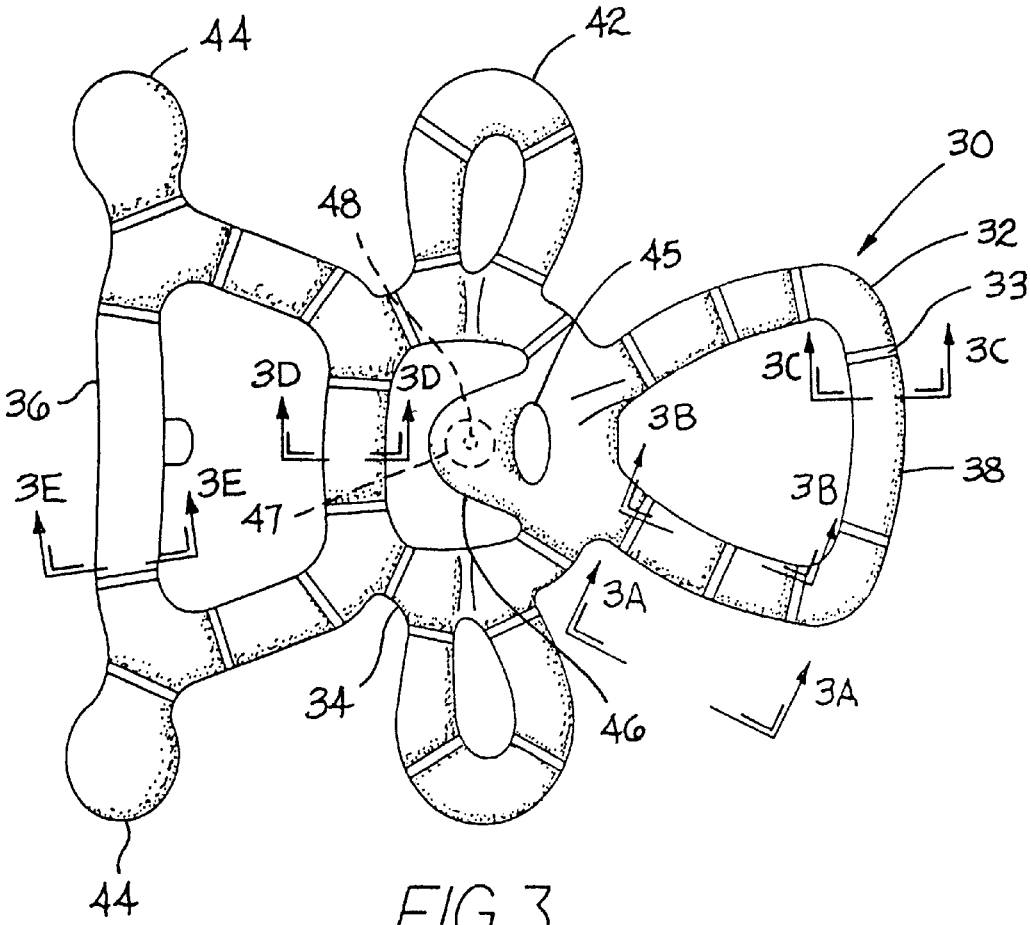
FIG. 3 is a plan view of the inflatable liner seen in FIG. 1 depicting the shape of the liner when placed upon a flat supporting surface.

The structure of the liner 30 (as discussed below) permits it to be made flat (as opposed to being made in a shape complementary to the shape of the wearer's head). This simple feature permits the liner 30 to be made using various molding techniques for making hollow bodies. The liner 30 can best be visualized as a hollow flexible body having a centrally disposed ring 34 from which four protective lobe groups outwardly extend. In a preferred embodiment, each lobe group forms an annular shape or loop as best illustrated in FIG. 3, namely, a front loop 36, a rear loop 38, a left loop 40, and a right loop 42. The front loop 36 may also be provided with a pair of pods 44 extending therefrom. While a loop configuration is preferred, other configurations may be utilized for the protective lobe groupings such as, for example, a plurality of fingers or other shapes that provide suitable protection and are geometrically compatible.

Figure 5:
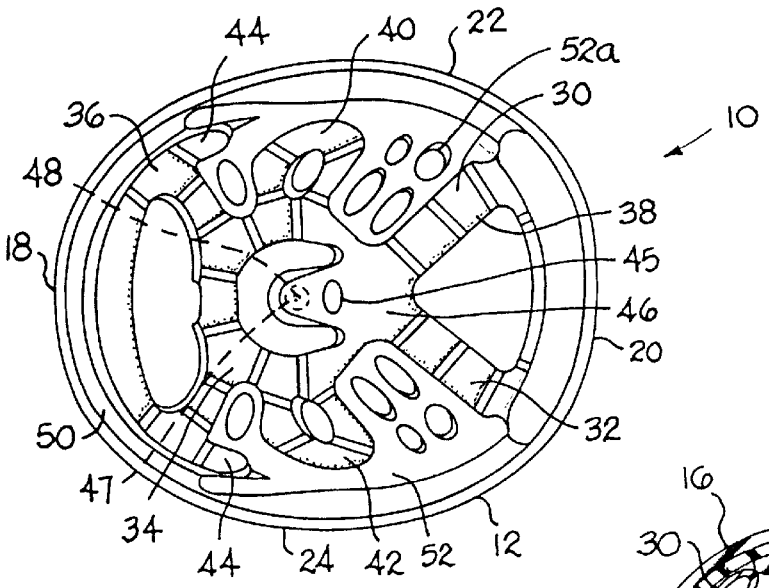
FIG. 5 is sectional view of the shell portion of the football helmet of FIG. 1 taken along line 5—5 of FIG. 1 and showing the preferred positioning of the internal padding and inflatable liner of the helmet.
Figure 6:
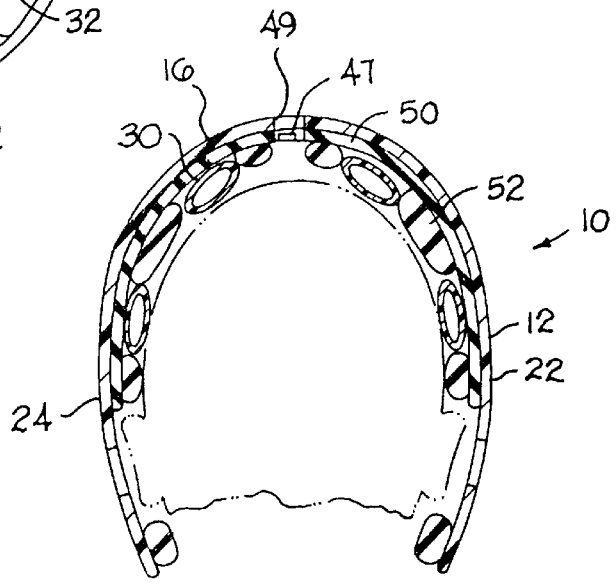
FIG. 6 is a sectional view of the football helmet of FIG. 1 taken along line 6—6 of FIG. 1.
Figure 7:
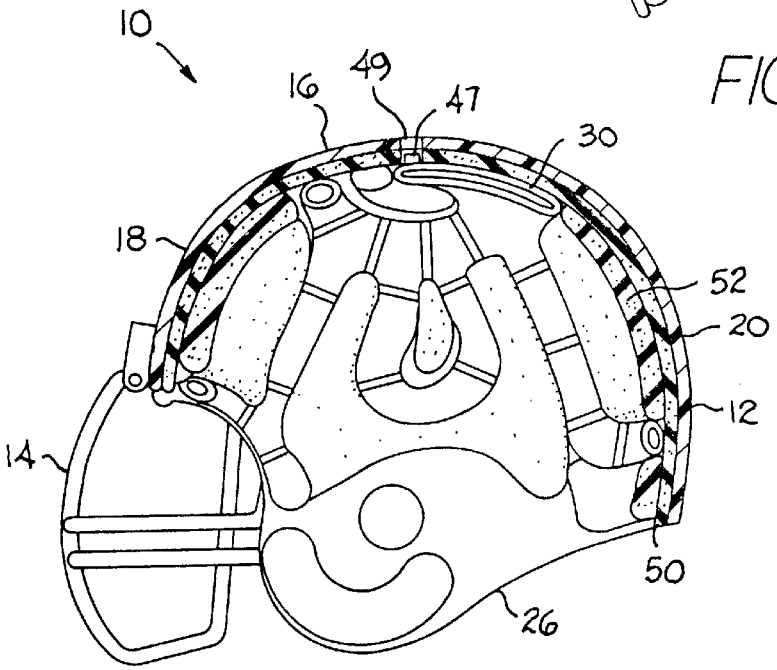
FIG. 7 is a sectional view of the football helmet of FIG. 1 taken along line 7—7 of FIG. 2.

It is additionally preferred that the peripheral shape of the liner 30 be formed such that, when the liner is folded and positioned within the shell 12, it fits within the spacing formed by the pads 52 in the manner shown in FIGS. 5–7. When in position, the liner 30 and the pads 52 form a substantially co-extensive protective surface abutting the skull of the wearer. Although the liner may, if desired, be physically secured to the shell 12 (or covering thereto), it is preferably that the liner be removably held in place solely by the frictional engagement with the pads 52. This aids in the quick manual removal and replacement of the liner as needed.

Figure 3A:
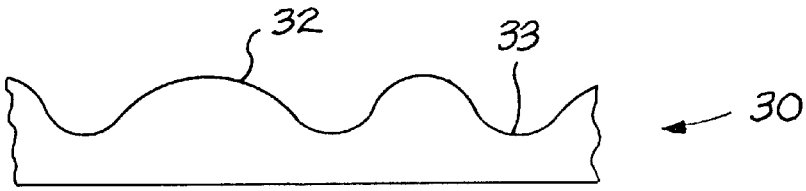
FIG. 3A is a side view of the liner taken along lines 3A—3A of FIG. 3.
Figure 3B:
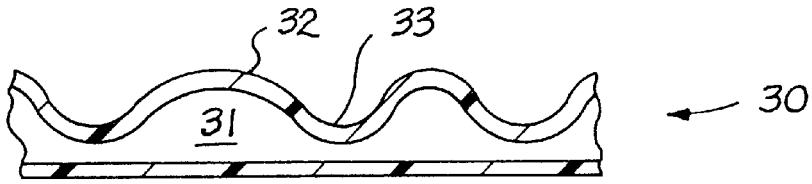
FIG. 3B is a side sectional view of the liner taken along lines 3B—3B of FIG. 3.
Figure 3C:
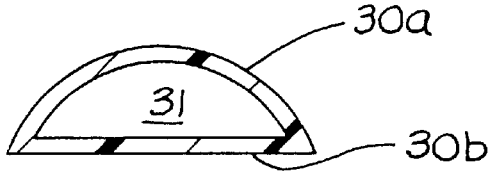
FIG. 3C is a side sectional view of a liner cell taken along lines 3C—3C of FIG. 3.
Figure 3D:
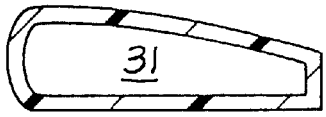
FIG. 3D is a side sectional view of a cell in the crown portion of the liner taken along lines 3D—3D of FIG. 3.
Figure 3E:
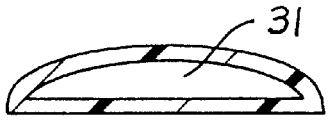
FIG. 3E is a side sectional view of an interconnecting passageway between cells of the liner taken along lines 3E—3E of FIG. 3.

The liner 30 is segmented into a multiplicity of individual cells 32 separated by constrictions 33 as illustrated in FIG. 3, the side view of FIG. 3A, and the sectional view of FIG. 3B. Except for the central ring, the surface 30*a* of the liner 30 is comprised of essentially semi-cylindrical shapes extending along the loops. The reverse side 30*b* of the liner 30 is essentially flat. The surface configurations have important uses as discussed below.

Referring to the sectional views portrayed by FIGS. 3B to 3E, it can be seen that the internal structure of the cells 32 further define passageways 31 that are interconnected directly through the constrictions 33. Additionally, as depicted in FIG. 3, the liner 30 has a valve cell 46 which extends from crown ring 34 toward the center thereof and includes a boss 47 housing a valve 48. The valve 48 permits the inflation and deflation of the liner 30 as desired through the use of an inflating needle.

It is preferred that this inflatable liner 30 be constructed of a synthetic rubber or thermal plastic elastomer capable of holding pressurized air. Such materials provide the needed flexibility for expansion and contraction, are durable, and are resistant to environmental degradation. Provided that these basic criteria are satisfied, other materials may also be used without departing from the spirit and scope of the present invention.

FIG. 3A, portraying a side view of two adjacent cells 32 of the preferred liner 30, and FIG. 3B, portraying a sectional side view of the same adjacent cells 32 of the liner 30, show in greater detail the preferred structure of the liner 30, including the air passageway 31 through the constrictions 33 that connect the adjacent cells 32. The smaller cross-sectional area of the passageways 31 in the constrictions 33 resist expansion to a greater degree than the cells 32 themselves when pressurized air is introduced into the liner 30, thereby providing a buffer against further expansion of the cells 32, which otherwise may result in undesirable ballooning of the liner. Additionally, forming the liner 30 from a plurality of separate and spaced individual cells in this manner provides for a more uniform inflation of the liner 30. Finally, by forming the liner 30 from a series of interconnected cells 32, the liner 30 may easily be flexed or contorted (with the flexing of the liner 30 occurring predominantly along the constrictions 33) to fit inside of the shell 12 of the helmet 10. In this regard, it is also important to note several important features of the liner of the present invention. First, the structure of the central ring with four loops connected only to the ring, but not to each other, permits the liner 30 to be molded in an essentially flat configuration as shown in FIG. 3 and then flexed into position within the helmet. Second, the flat rear surface 30*b* of the liner 30 abuts the internal components of the helmet 10 and provides for a smooth contact surface. Finally, the opposite surface 30*a* having an essentially rounded surface, preferably cylindrically shaped on the various loops, abuts the head of the wearer directly, but due to its rounded nature, provides an area of contact that is limited, allowing spacing between the areas of contact, and thus permits air circulation and cooling. This should be contrasted to the padding and flat surfaces of prior art liners that cover a much larger area of the scalp, exasperating the cooling problems often occurring during strenuous activities in athletic events.

It should be noted that the central crown ring 34 preferably has a generally circular shape. The front loop 36 has a generally trapezoidal shape, the smaller base of the trapezoid forming a portion of the circumference of the ring 34. From FIG. 3D, it may be seen that the cross section of the ring 34 converges toward the outer circumference so as to present an essentially wedge-shape in cross section. This configuration permits a more accurate fitting when positioned on the wearer's crown. For added comfort and protection, in this preferred embodiment, left and right temple pods 44 extend from the lower corners of the front loop 36 and are adapted to rest against the wearer's temples on either side of his forehead. The rear loop 38 of the liner 30 has a generally triangular shape in plan view with the vertex of the triangle intersecting the circumference of the central crown ring 34, opposite the front loop 36. The left and right loops 40, 42 of the liner 30 also each have a generally circular shape in plan view, each of said circles sharing a portion of their circumference with the circumference of the central crown portion 34.

The valve 48 is preferably a self-sealing valve that is opened and accessed through the insertion of an inflating needle. This type of valve is commonly used to inflate footballs and basketballs. As stated above, this valve 48 may be accessed by the inflating needle via the small opening 49 through the crown portion 16 of the helmet 10. It has been noted that over-inflation of portions of inflatable liners, particularly in the regions adjacent to the valve, is a problem typical in the prior art. As can be seen in FIG. 3, the preferred geometry of the liner 30 requires that the inflating cell 46 be substantially larger than other cells 32. To prevent over-inflation of this particular cell 46, which would cause the entire helmet 10 to rise undesirably on the wearer's head, it is preferred to provide the inflating cell 46 with an aperture 45 that structurally restricts the expansion of the cell 46 beyond an acceptable size.

Because it is important that the liner 30 be flexible enough after molding to be fitted within helmet frame as shown in FIG. 5 yet amenable to inflation, the actual thickness of the liner must be controlled. As stated before, the material itself used in the molding process to fabricate the liners can be synthetic rubber or one of many elastomeric materials capable of holding pressurized air. Although the preferred thickness will vary depending upon the selected material, it has been found that a thickness from slightly less than one-sixteenth of an inch to about three sixteenths of an is preferred. Dimensions in excess of the preferred thickness tend to prevent proper inflation and positioning while smaller thicknesses promote undesirable ballooning in certain parts of the liner 30. The inside cell dimensions may be between about ¼ inch to about ⅝ inch wide and about 3/16 inch to about ⅜ inch high measured to the vertex of the opening. The constrictions may have width between about ¼ inch to about ⅝ inch and a height to the vertex of the opening about ⅛ inch to about ⅜ inch.

FIG. 4 shows a preferred padding configuration that can be used in combination with the helmet 10 and preferred inflatable liner 30 described above. First, the interior surface of the shell 12 of this preferred helmet 10 is almost completely lined with a layer of polypropylene 50. This layer of polypropylene 50 aids in the attenuation of a portion of the translational energy associated with the force of an impact to the helmet 10. Individual foam pads 52 are then secured to the polypropylene layer 50. As stated above, the pads 52 are constructed and positioned such that the preferred inflatable liner 30 can be fit between and around them, in frictionally engagement with the peripheries, as shown in FIGS. 5–7.

As discussed above, the surface 30*a* of liner 30 is rounded to 15S provide spacing for the "breathing" of the wearer's skin. As perhaps best seen in FIGS. 4 and 5, pads 52 may be have portions 52*a* of its surface which are raised, thus providing for further spacing to facilitate air circulation near the skin of the wearer's skull.

As illustrated in FIGS. 5–7, it may be observed that the shell 12 defines a small opening 49 through the crown portion 16 of the helmet 10 (as best shown on FIG. 2). This feature allows the valve 48 used to inflate/deflate the liner 30 to be accessed while the helmet 10 is being worn.

It is important to note that the front loop 36 of the liner 30 preferably extends to the front edge of the helmet 10 as is defined by the bottom opening 26. Also, the rear loop 38 of the liner 30 preferably extends downwardly past the external occipital protuberance, a prominent bony protrusion on the back a wearer's head. Because the liner 30 extends past the external occipital protuberance in the rear and down to the edge of the helmet 10 in the front, the helmet 10 will not rise up or lift away from the wearer's head when the liner 30 is inflated. To further aid in providing a snug and comfortable fit, the generally circular shape of the left and right side loops 40, 42 of the liner 30 provide a means for offsetting the geometric differences between the shape of the helmet 10 and the shape of the wearer's head.

The combination of the ABS shell 50, polypropylene layer 50, pads 52, and inflatable liner 30 results in a protective helmet 10 that snugly fits on a wearer's head, provides for attenuation of some of the translational energy associated with the force of an impact to the helmet, yet permits good air circulation within the helmet when being worn. Once the wearer places the preferred helmet 10 on his head, it is a simple process to inflate the liner 30, requiring only the insertion of an inflating needle, that is operably connected to a pump, through the opening 49 defined by the crown portion 16 of the shell 12. The pump is then used to inflate the liner 30 until a snug and comfortable fit is achieved.

It will be obvious to those skilled in the art that modifications may be made to the preferred embodiments described herein without departing from the spirit and scope of the present invention.

What is claimed is:

1. An inflatable liner for use in a protective helmet comprising an inflatable seamless body defining a multiplicity of internally disposed cells with each cell being separated from an adjacent cell by a constriction having a smaller internal cross-sectional area than said cells, said cells and constrictions forming a continuous passageway for the passage of air throughout said body;

said body further defining a centrally disposed crown portion in the form, of a ring of said cells and constrictions that is adapted to be positioned against and protect the top portion of the wearer's skull, a rear group of said cells and constrictions extending outward from said ring and adapted to be positioned against and protect the lower portion of the wearer's skull, a pair of side groups of said cells and constrictions extending outward from opposite sides of said ring and adapted to be positioned against and protect the sides of the wearer's skull, and a front group of said cells and constrictions extending out from said ring and adapted to be positioned against and protect the top front portion of the wearer's skull, said body having a first side that is substantially flat thereby facilitating the positioning of said first side against the internal surface structure of the helmet; and a valve connected to said body for permitting said body to be inflated and deflated with air whereby said body when inflated to a desired pressure is adapted to be inserted into a helmet with the flat surface juxtaposed against the inside surface structure of the helmet.

2. The inflatable liner of claim 1 in which said valve is positioned on a valve cell that extends inwardly from said ring into an opening defined by the ring, said valve cell having a larger volume than the other cells and further being sealed about an aperture to minimize ballooning of the valve.

3. The inflatable liner of claim 1 in which said body has a second side that is curved and adapted to be in contact with the head of the wearer thereby fixing said helmet relative to said wearer's head and permitting atmospheric air to circulate between areas of contact between said curved surfaces and the wearer.

4. The inflatable liner of claim 1 in which said front, rear, and side groups of cells, respectively form loops of said cells extending outwardly from said central ring of said cells.

5. A protective helmet for the protection of a wearer engaged in athletic events comprising a rigid shell;

a layer of material attached to said shell for attenuating a portion of translational forces associated with impacts;

a plurality of pads attached to said layer and forming a first predetermined configuration defining open areas;

an inflatable seamless body defining a multiplicity of internally disposed cells with each cell being separated from an adjacent cell by a constriction having a smaller internal cross-sectional area than said cells, said cells and constrictions forming a continuous passageway for the passage of air throughout said body, said body having a second configuration such that, when said body is positioned in said open areas defined by said plurality of pads, a periphery of said body abutting said pads with friction sufficient to maintain said body within said area.

6. The protective helmet of claim 5 in which said body further defines a centrally disposed crown portion in the form of a ring of said cells and constrictions that is adapted to be positioned against and protect the top portion of the wearer's skull, a rear group of said cells and constrictions extending outward from said ring and adapted to be positioned against and protect the lower portion of the wearer's skull, a pair of side groups of said cells and constrictions extending outward from opposite sides of said ring and adapted to be positioned against and protect the side of the wearer's skull, and a front group of said cells and constrictions extending out from said ring and adapted to be positioned against and protect the top front portion of the wearer's skull, said body having a first side that is substantially flat thereby facilitating the positioning of said first side against the internal surface structure of the helmet; and a valve connected to said body for permitting said body to be inflated and deflated with air whereby said body when inflated to a desired pressure is adapted to be inserted into a helmet with the flat surface juxtaposed against the inside surface structure of the helmet.

7. The inflatable liner of claim 6 in which said front, rear, and side groups of cells, respectively form loops of said cells extending outwardly from said central ring of said cells.

8. The protective helmet of claim 7 in which said plurality of pads have portions of the surfaces thereof which are raised and said rear, front and side loops have rounded surfaces collectively forming a co-extensive surface adapted to abut against the wearer's skull and forming spaces for the circulation of air.

9. A method for making a helmet with an inflatable and removable liner comprising the steps of:

forming a helmet shell with an internal surface adapted to fit on the skull of a wearer;

forming padding having a first predetermined configuration and periphery;

attaching said padding to said helmet adjacent said internal surface of said helmet shell; and molding a flexible and inflatable liner said liner being molded as a unitary and seamless body into an essentially flat second configuration and periphery in which said liner defines a plurality of cells separated by constrictions; and manipulating and positioning said flexible and inflatable liner within said shell in frictional and abutting engagement with the periphery of said padding.

10. The method of claim 9 in which said liner is molded into a centrally disposed crown portion in the form of a ring of said cells and constrictions that is adapted to be positioned against and protect the top portion of the wearer's skull, a rear group of said cells and constrictions extending out from said ring and adapted to be positioned against and protect the lower portion of the wearer's skull, a pair of side groups of said cells and constrictions extending out from opposite sides of said ring and adapted to be positioned against and protect the sides of the wearer's skull, and a front group of said cells and constrictions extending out from said ring and adapted to be positioned against and protect the top front portion of the wearer's skull, said liner having a first surface that is substantially flats, thereby facilitating the positioning of the first surface of said liner against the internal surface of the helmet.

* * * * *